United States Patent [19]

Suzuki

[11] 4,015,092

[45] Mar. 29, 1977

[54] MULTIPLE SWITCH ASSEMBLY FOR ELECTRICALLY OPERATED INSTRUMENT

[76] Inventor: Yoshiro Suzuki, No. 7-15, 1 chome, Shirakawa Koto-ku, Tokyo, Japan

[22] Filed: Apr. 25, 1975

[21] Appl. No.: 571,626

Related U.S. Application Data

[62] Division of Ser. No. 472,688, May 23, 1974, Pat. No. 3,897,708.

[30] Foreign Application Priority Data

May 24, 1973 Japan ..... 48-58469

[52] U.S. Cl. ..... 200/5 R; 84/DIG. 7; 200/6 C; 200/283

[51] Int. Cl.[2] ..... H01H 1/34; H01H 5/18; G10D 7/06

[58] Field of Search ..... 200/1 A, 17 K, DIG. 46, 200/283, 1 R, 5 R, 5 A, 6 R, 6 BB, 6 C; 84/423, DIG. 7, 1.01

[56] References Cited

UNITED STATES PATENTS

| | | | |
|---|---|---|---|
| 2,560,324 | 7/1951 | Babcock, Jr. | 200/1 TK UX |
| 2,624,809 | 1/1953 | Sinclaire | 200/1 A X |
| 3,576,958 | 5/1971 | Ohno | 200/1 A |
| 3,872,263 | 3/1975 | Wilder et al. | 200/1 A X |

*Primary Examiner*—James R. Scott

[57] ABSTRACT

This invention relates to a musical instrument operated by keys which in turn actuate change-over switches for selecting a predetermined one of a series of sound generators. The switches are provided by a composite structure constituted of aligned panels which carry the switch contact, the movable arms of which are operated by the keys.

1 Claim, 11 Drawing Figures

MULTIPLE SWITCH ASSEMBLY FOR ELECTRICALLY OPERATED INSTRUMENT

The present application is a division of my parent application Ser. No. 472,688 filed May 23, 1974 now U.S. Pat. No. 3,897,708, for an invention entitled Electrically Operated Musical Instrument. The present divisional application is directed to a composite switch structure having particular advantage when adapted to the electrically operated musical instrument of said parent application.

Woodwind instruments such as a saxophone, a flute, a clarinet and the like utilize a reed mouthpiece for producing sound with pitch variations as a function of breath-release pressure within the mouthpiece, a hollow tube resonating the produced tones and a plurality of depressable keys actuating valves which modify the effective tube length to produce frequency variations whereby in turn to produce musical notes as a function of the keys depressed by the player. The distance between the mouthpiece and valve is generally several times the wave length of each musical scale. The characteristic of each musical note is determined by the size, shape and the material of which the tube is made. Since the tube design is substantially uniform for woodwind instruments, the fingering is substantially the same for each woodwind instrument.

Various improvements have been made in devices for use as musical instruments intended to emit sounds similar to the conventional woodwind instruments referred to. Thus, recent electrically operated instruments such as an electone and the like, are provided with a sound generation circuit for producing sound with a predetermined wavelength, the frequency and amplitude control being obtained by analyzing specific soundwaves to be produced, these instruments including switch and amplification circuits.

Musical sounds with known instruments are made by depressing multiple keyboards in parallel arrangement, keys in one keyboard being actuated independently of other keyboards to actuate corresponding switches in relevant circuits for producing the musical tones desired. With such arrangement the sound source is initially connected to the generation circuit by selecting the keyboards which are disposed in a symmetrical relation and then the oscillating tone is connected to the amplification circuit to produce the desired musical sound. The foregoing arrangement, while effective for musical instruments of the keyboard type, is not readily adaptable to a musical instrument which is to operate as a woodwind instrument such as a saxophone and the like where one musical sound (note) is obtained by certain combinations of simultaneously depressed keys. Known keyboard-operated electric instruments heretofore used moreover produce timber variations by switching timber circuits, timber being changed by synthesizing different sound frequencies.

Considering the foregoing and the recently attained recognition of electrical musical instruments, an objective of my invention is to provide a novel electric instrument which includes switch groups and related circuits completed when keys on the instruments are operated wth finger action similar to that used in depressing keys of conventional woodwind instruments. To achieve this objective, I provide an electrically operated musical instrument which includes groups of change-over switches of a number corresponding to the number of keys which the conventional woodwind instrument has. My instrument also includes groups of sound generators for generating notes of predetermined frequencies in a given scale, current paths being provided to the generators by selecting combinations of change-over switches governed by combinations of key depressions on the musical instrument to provide notes of predetermined frequency generated by the sound generators. The change-over switches have contacts a first group of which are provided on an external contact panel and the second group of which are provided on an internal contact panel, there being interposed between such external and internal panels an intermediate panel carrying movable contacts of the change-over switches. When the keys of the musical instrument are actuated, the movable contacts on the intermediate panel engage the contacts on the internal panel and when released engage the contacts on the external panel. The contacts on the interior and external panels are wired to provide current paths to the sound source generators which produce sounds determined by the finger operation of the keys on the instrument. The external and internal contact panels and the intermediate contact panel therebetween are accommodated in a casing of the musical instrument of the invention.

A further objective of the invention is to provide an electrically operated musical instrument which enables production of desired musical tones with simple circuit arrangements.

Another objective of the invention is to provide an electrically operated musical instrument which is capable of producing appropriately controlled and delicate musical sounds.

A further objective of the present invention is to provide an electrically operated musical instrument which produces a desired musical sound without being burdened by the limitations of size or configuration as in the case of conventional woodwind instruments.

Other objects and advantages of the present invention will become apparent as the detailed description thereof proceeds.

For a fuller understanding of the present invention reference will now be had to the following detailed description thereof taken in conjunction with the accompanying drawings, wherein.

Figure 1:
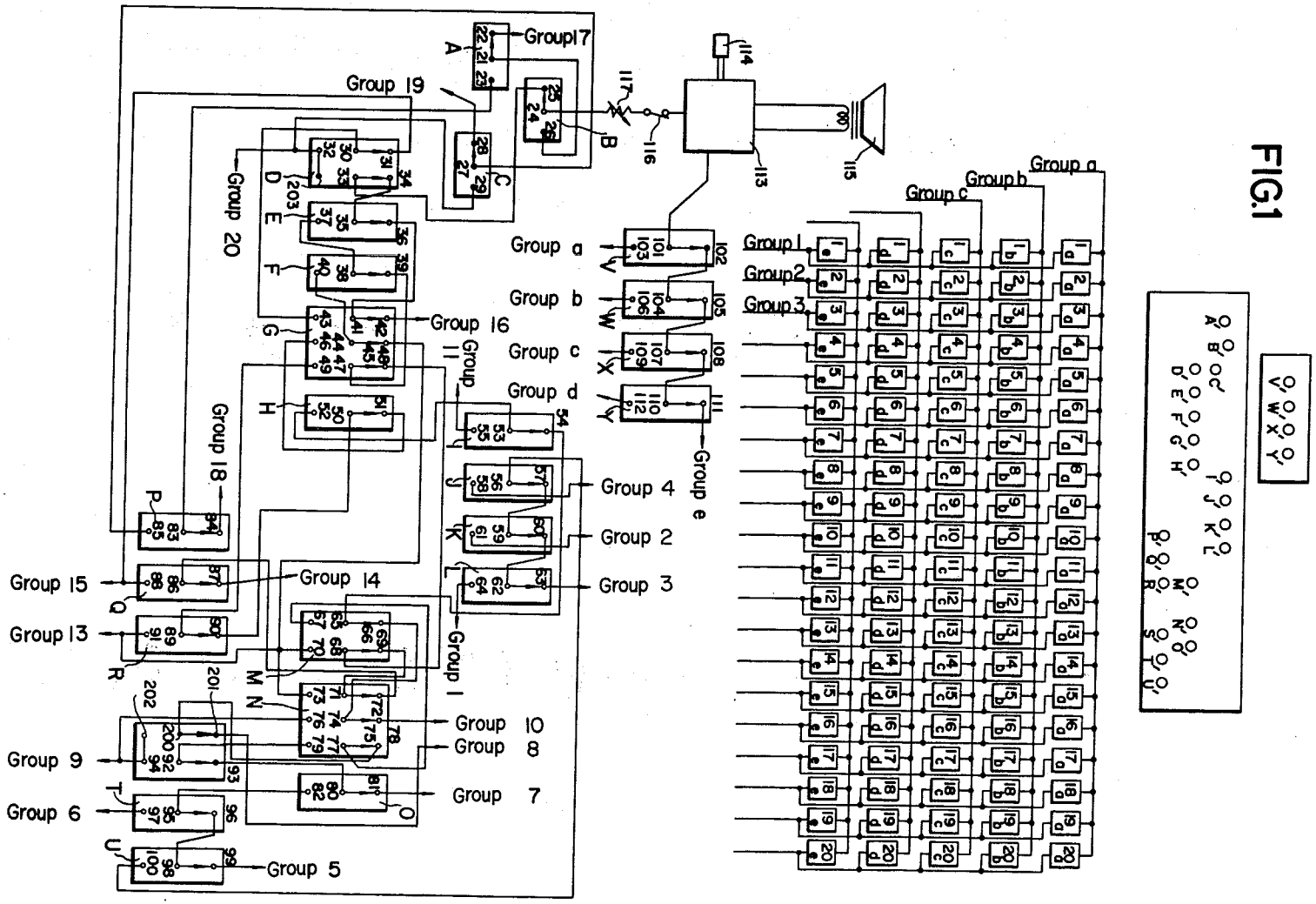
FIG. 1 is an entire circuit diagram of the musical instrument embodied according to the invention.
Figure 3:
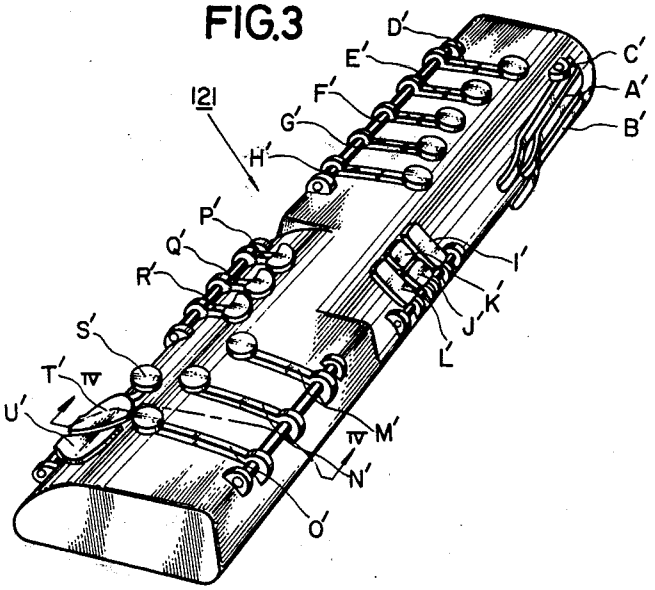
FIG. 3 is a perspective view of the switch casing.

FIG. 1 is a circuit diagram of the overall system constituting the musical instrument of the invention and includes keys A'—Y' inclusive mounted in relation to one another on a casing (see FIG. 3) in a manner to correspond to the spacial relationship of the keys on a woodwind instrument, such, for example, as a saxophone. The system includes switch groups A-Y inclusive, each switch having a movable contact and fixed contacts and being operated by the correspondingly lettered key "primed", as will be more fully disclosed hereinafter. The mechanical linking for example of key A' with switch A, key B' with switch B etc. has not been illustrated in FIG. 1 in the interest of clarity and to avoid confusion.

The system further includes sound wave generators divided into groups such as groups 1, 2, 3, . . . . 20 as illustrated in FIG. 1. The sound wave generators are furthermore divided into groups *a, b, c, d,* and *e.* It is to be understood that each of the sound generators in a given vertical column, i.e., group 1 emit the same note, for example, $B^b$ but with octave differentials, the same applying to the group 2 sound generators which are also designed to emit the same note, for example, B, but with octave differences governed by keys V', W', X' and Y' and the corresponding switches V, W, X and Y the actuation of which determine which octave is selected in groups a-e.

As will be seen from FIG. 1, group 1, 2, 3 . . . . 20 sound generators are vertically oriented and connected in parallel while group *a, b, c, d,* and *e* sound generators are horizontally oriented and also connected in parallel.

Figure 7:
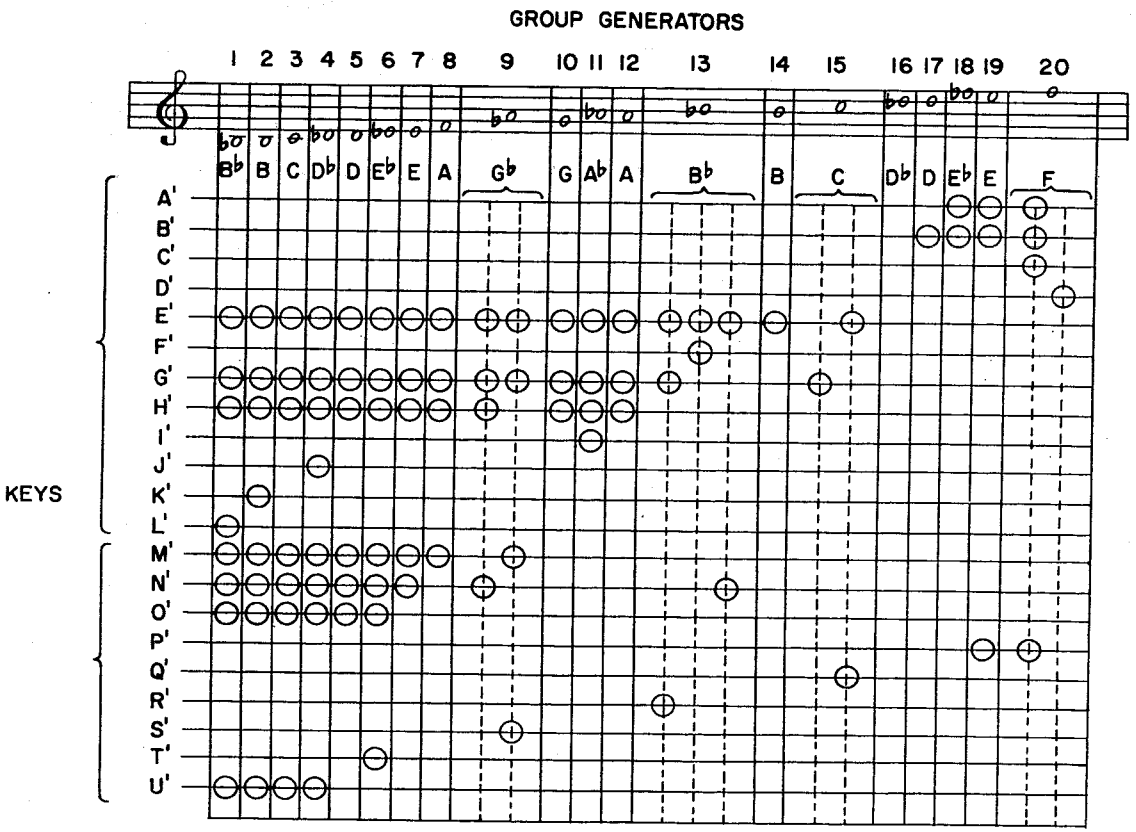
FIG. 7 is a graph showing the musical notes produced by group generators 1 to 20 and the keys which are depressed to select the sound generators.

The notes adapted to be produced by the sound generators in groups 1 to 20 and the keys A' to U' which have to be operated to produce such notes is shown in FIG. 7.

Thus, keys A' - U' respectively control the operational state of switches A to U and select as shown in FIGS. 1 and 7 the numbered groups of sound generators; i.e. group 1, 2, 3, . . . . 20. Thus it will be appreciated that operating a key such for example as key B' will operate switch B which in turn selects one of the numbered groups of sound generators (group 17) and that operating any one of octave keys V', W', X' or Y' will operate the corresponding switch V, W, X or Y with consequent selection of any one of groups *a, b, c* or *d* or group *e* if none of keys V' to Y' is operated. It will therefore be appreciated that by operating keys A'-U' and keys V'-Y' it is possible to select one or more sound generators by means of the circuitry shown in FIG. 1 which shows how the various switches are interconnected not only in relation to one another but also with the groups of sound generators.

More specifically, to exemplify the inventive concept, and having reference to FIGS. 1 and 7, if the note B (group 14 sound generators) is to be produced, the key E' is actuated so that movable contact 35 of switch E is separated from contact 36 and brought into engagement with contact 37. In consequence, the following circuit will be established between amplifier 113 and one of the group 14 generators starting from amplifier 113, ignoring elements 116 and 117 for the time being, contacts 24, 25, 33, 34, 35, 37, 38, 39, 47, 48, 68, 69, 71, 72, 86 and 87, which latter contact as seen in FIG. 1 leads to the group 14 sound generators. Hence, on depression of key E' group 14 sound generators will be selected. It will be equally clear that depressing one of keys V'-Y' will through switch circuits V-Y select one of the group 14 sound generators in group *a, b, c* or *d* depending upon the octave key operated. Group e sound generators will be selected as previously indicated if none of the keys V'-Y' are operated. As will be seen from the circuit in FIG. 1, a group d generator will be selected when only key Y' is operated, group c when only key W' is operated and group a when only key V' is operated.

The intention of the foregoing description is to provide a general understanding of the invention. The following disclosure more specifically describes the invention with respect to the accompanying drawing. Suffice it to say that the invention is not restricted to fixed relationships between the octave keys and keys A' to U' for selecting a predetermined sound generator and therefore for producing a given note. FIG. 7 clearly shows, for example, that group 15 generators may be selected by either operating key G' alone or keys E' and Q' simultaneously.

FIGS. 1 and 7 jointly considered illustrate the various notes ($B^b$, B, C, $D^b$ . . . . etc.) that can be produced upon depressing one or more of the keys A' to U' with actuation of corresponding switches A to U, to select one or more of the sound generators 1 to 20. Thus, group 1 sound generators will be selected for producing note $B^b$ by operating keys E', G', H', L', M', N', O' and U'; group 2 sound generators *2a, 2b, 2c,* . . . . will be selected for generating note B by operating keys E', G', H', K', M', N', O' and U'; group 3 sound generators will be selected for generating note C by operating keys E', G', H', M', N', O' and U'; group 4 sound generators will be selected for generating note $D^b$ by operating keys E', G', H', J', M', N', O' and U'; group 5 sound generators will be selected for generating note D by operating keys E', G', H', M', N' and O'; group 6 sound generators will be selected for generating a note $E^b$ by operating keys E', G', H', M', N', O' and T'; group 7 sound generators will be selected for generating note E by operating keys E', G', H', M', and N'; group 8 sound generators will be selected for generating note A by operating keys E', G', H' and M'; group 9 sound generators for generating note $G^b$ by operating keys E', G', H', and N' or E', G', M' and S'; group 10 sound generators for generating note G by operating keys E', G' and H'; group 11 sound sound generators for generating note $A^b$ by operating keys E', G', H' and I'; group 12 sound generators for generating note A by operating keys E', G' and H'; group 13 sound generators for generating note $B^b$ by operating keys E', G', and R', or E' and F' or E' and F'; group 14 sound generators for generating note B by operating key E'; group 15 sound generators for generating note C by operating key G', or E' and Q'; group 16 sound generators for generating note $D^b$ by not operating any of keys A' to U'; group 17 sound generators for generating note D by operating key B'; group 18 sound generators for generating note $E^b$ by operating keys A' and B'; group 19 sound generators for generating note E by operating keys A', B', and P'; and group 20 sound generators for generating note F by operating keys A', B', C' and P' or D'.

As previously noted the generators generally are arranged in a horizontal grouping including elements *a, b, c* . . . . , individual generators in the vertical and horizontal groups being connected in parallel with each other.

The generators 13*a*, 13*b;* 14*a*, 14*b;* and 15*a*, 15*b* are provided for dual key operation in the same octave stage for smooth finger key operation; also generators 16*a*, 16*b*; 17*a*, 17*b*; and 20*a*, 20*b* are provided to generate still one octave higher musical sound. The number of the generators included in the musical instrument is governed by purpose. The scale change-over switches A . . . . U, of a number equal to that of the keys of a saxophone, control circuit paths between amplifier 113 and the sound generators with which the switches are electrically connected by wiring means. By manually depressing the keys, in the manner of operating a saxophone, selected contacts of the switch are engaged by movable contacts thereof to establish current paths to a selected generator. The change-over switches A . . . . U are connected in series with each other and provide different current paths dictated by the contacts engaged by the movable contact of a given switch. As will be more fully described hereinafter each switch movable contact is either in engagement with one or another of the fixed contacts of the switch, engagement with one of the fixed contacts being effected in the non-operated position of a key and with the other fixed contact on operation of the key.

The musical instrument is normally provided with twenty-one scale operation keys A'. . . U' which govern the operational state of the change-over switches A . . . U respectively. The change-over switch A is provided with the contacts 21, 22 and 23, the change-over switch B with a contact 24 functioning as an input terminal and contacts 25 and 26 and likewise the change-over switch U is provided with the contacts 98, 99 and 100. On non-operation of any of the keys A' to U', the following contacts will be engaged. For switch A contacts 21 and 22; for switch B contacts 24 and 25; for switch C contacts 27 and 28; for switch D contacts 30 and 31 as well as 33 and 34; for switch E contacts 35 and 36; for switch F contacts 38 and 39; for switch G contacts 41 and 42, 44 and 45 as well as 47 and 48; for switch H contacts 50 and 51, for switch I contacts 53 and 54; for switch J contacts 56 and 57; for switch K contacts 59 and 60; for switch L contacts 62 and 63; for switch M contacts 65 and 66 as well as 68 and 69; for switch N contacts 71, and 72, 74 and 75 as well as 77 and 78; for switch O contacts 80 and 81; for switch P contacts 83 and 84; for switch Q contacts 86 and 87; for switch R contacts 89 and 90, for switch S contacts 200 and 201 as well as contacts 92 and 93; for switch T contacts 95 and 96; and for switch U contacts 98 and 99. Further, the switches are interconnected. Thus, switch A is connected to switch B by interconnecting the contacts 21 and 26, switch A to P by interconnecting contacts 23 and 83, switch B to D by interconnecting contacts 25 and 33. In like manner and for the same purpose the following contacts are interconnected; contacts 27 and 85; contacts 30 and 43; contacts 34 and 35; contacts 36 and 41; contacts 37 and 38; contacts 39 and 47; contacts 40 and 44; contacts 46 and 51; contacts 48 and 68; contacts 49 and 89; contacts 50 and 90; contacts 52 and 53; contacts 54 and 65; contacts 56 and 100; contacts 57 and 59; contacts 60 and 62; contacts 66 and 74; contacts 67 and 77; contacts 69 and 71; contacts 72 and 86; contacts 78 and 200; contacts 79 and 92; contacts 80 and 93; contacts 82 and 95 and between the contacts 96 and 98; contacts 94 and 202 and contacts 32 and 203. Furthermore, contact 64 is connected to the group 1 generators, contact 63 to the group 2 generators, contact 61 to the group 3 generators, contact 58 to the group 4 generators, contact 99 to the group 5 generators, contact 97 to the group 6 generators, contact 81 to the group 7 generators, contact 201 to the group 8 generators, contacts 76 and 94 to the group 9 generators, contact 75 to the group 10 generators, contact 55 to the group 11 generators, contact 51 to the group 12 generators, contacts 45, 70, 73 and 91 to the group 13 generators, contact 87 to the group 14 generators, contacts 31 and 88 to the group 15 generators, contact 42 to the group 16 generators, contact 22 to the group 17 generators, contact 84 to the group 18 generators, contact 28 to the group 19 generators and contacts 29 and 32 to the group 20 generators.

As hereinbefore described each of the current paths to the group 1 to group 12 generators for generating the different notes in a scale (see FIG. 7) is selected by operating the relevant key or keys in the same manner of operating the keys of a saxophone instrument. As will be seen from FIG. 7, the same note may be produced by operating different combination of keys which selectively control the circuit path between a selected sound generator and amplifier.

For example, the current path to group 14 or 15 sound generators is established respectively through switch E (for group 14) or G or E, Q, (for group 15) by operating keys E' or G' or E', Q' respectively. Also it will be seen from FIG. 7 that to switch from sound generator 14 to sound generator 15 it is only necessary to depress the key Q' in addition to key E' which latter key selects the group 14 generators. In like fashion to switch from a group 8 generator to a group 7 generator it is only necessary to depress the additional key N' as will be seen from the showing in FIG. 7.

Figure 2:
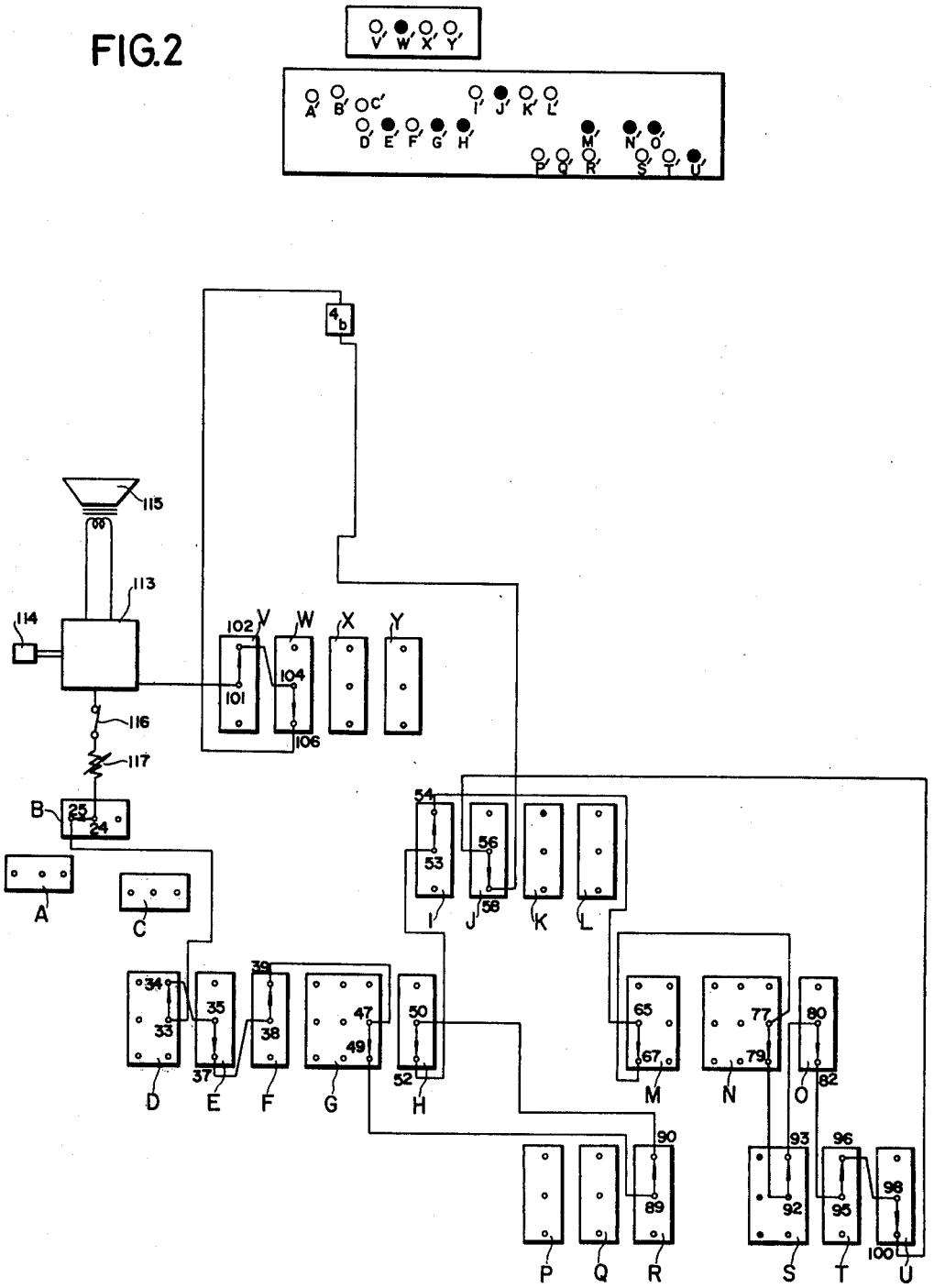
FIG. 2 is a circuit diagram for actuating a specific generator in accordance with the fingering.

Referring now to FIG. 2, this Figures illustrates the selection of, for example, group 4 generators which emit the note $D^b$. This note will be generated by depressing keys E', G', H', J', M', N', O' and U' which selectively operate switches E, G, H, J, M, N, O and U by closing contacts 35 and 36, contacts 47 and 49, contacts 50 and 52, contacts 56 and 58, contacts 65 and 67, contacts 77 and 79, contacts 80 and 82 and contacts 98 and 100. Accordingly, the group 4 generators will be selected via contacts 24-25-33-34-35-37-38-39-47-49-89-90-50-52-53-54-6-5-67-77-79-92-93-80-82-95-96-98-100-56-58.

To mitigate against the possiblilty of producing undesired tones upon sequential operation of any of keys A' to U', two current paths are provided for the group 9 generators, the group 15 generators and the group 20 generators while three current paths are provided for the group 13 generators. For example, to produce the notes F and $G^b$ the keys E', G', H' and M' and keys E', G', H', and N' are sequentially operated. When it is desired to produce note $G^b$ and an error in fingering the keys is made by for example fingering keys E', G', H' and M' (note F) instead of E', G', H' and N' (note $G^b$) the error can be corrected so that the note F will not be sounded by merely depressing key S' (along with keys E', G', H' and M'; see FIG. 7). Likewise, multiple current paths are provided for the group 14 generators, the group 15 generator and for the group 20 generators.

The octave change-over switches V, W, X, and Y are operatively connected to the octave operation keys V', W', X' and Y' to provide current paths to the group *a* generators, the group "*b* generators, the group *c* generators, the group *d* generators and the group *e* generators of the octave stage. The change-over switch V is provided with the contacts 101, 102 and 103, the change-over switch W with the contacts 104, 105 and 106, the change-over switch X with the contacts 107, 108 and 109 and the change-over switch Y with the contacts 110, 111 and 112. When keys V' - Y' are not depressed, the change-over contact 101 of switch V engages the contact 102, contact 104 of switch W engages the contact 105, contact 107 of switch X engages contact 108 and contact 110 of switch Y engages contact 111. Furthermore, contact 102 is connected to contact 104, contact 105 to contact 107 and contact 108 is connected to contact 110. Contact 101 in turn is connected to the amplifier 113, contact 103 to the group *a* generators, contact 106 to the group *b* generators, contact 109 to the group *c* generators, contact 112 to the group *d* generators and contact 111 to the group *e* generators. On non-operations of the keys V'-Y' a current path is provided for the group *e* generators.

FIG. 2, as indicated, illustrates the circuit in which the group 4 generators are operatively selected by the scale changeover switches E, G, H, J, M, N, O and U to produce the tone $D^b$. If the octave group *b* is to be selected (generator 4*b*) the octave change-over switch is operated to produce a note at the octave level in the desired group *b*. At this time, current is supplied to the amplifier 113 through contacts 106-104-102-101.

The reference numeral 114 identifies a main switch, 115 a speaker, 116 an interrupting switch for producing a discontinuous sound when operating the musical instrument and 117 is a variable resistor for controlling the frequency of current supplied through the intermediary of switch 16 to the individual generators 1*a*, 1*b* . . . , 2*a*, 2*b* . . . . , and 20*a*, 20*b* . . . . , 20*e*. The interrupting switch 116 and the variable resistor 117 are adapted to convert the mechanical motion into electrical signals. For example, there may be provided an independent mouthpiece (not shown) corresponding to the reed mouthpiece of the wind instrument which may be provided with an interrupting switch 16 operated by pressure of the user's breath and the variable resistor 117 may be made responsive to the upward and downward movements of the jaw of the player. Thereby the mechanical movement of the interrupting switch and resistor 117 will affect the current flow to the sound generators.

Since frequency variation may also result from variation in inductance as well as electrostatic capacitance, element 117 might be provided in form of a variable impedance rather than as a variable resistor.

As indicated, FIG. 2 illustrates the circuit for selecting the group 4 generators for producing the note $D^b$ by depressing, as shown in FIG. 7, keys E', G', H', J', M', N', O' and U' which respectively operate switches E, G, H, J, M, N, O and U. The FIG. 2 circuits form part of the circuitry shown in FIG. 1 and can be traced in FIG. 1 via contacts 24, 25, 33, 34, 35, 37, 38, 39, 47, 49, 89, 90, 50, 52, 53, 54, 65, 67, 77, 79, 92, 93, 80, 82, 95, 96, 98, 100, 56 and 58. In like manner FIG. 1 shows the required connections between change-over switches A to U and the group of sound generators 1-20 to enable selection of any other sound generator in the series 1–20 by depressing the keys A' to U' singly, in combination, or not at all in accordance with the showing in FIG. 1. FIG. 1 also shows the required connections between the change-over octave switches V to Y and the group of sound generators *a* to *e* to enable selection of a predetermined sound generator in the series *a* to *e* by depressing keys V' to Y' respectively, singly, in combination or not at all. The circuit for selecting predetermined sound generators in groups 1 to 20 and in groups *a* to *e* via change-over switches are shown in FIG. 1. The circuits for each sound generator may be traced in the same manner as the circuit was traced for the group 4 generators. In each instance the circuit may be traced (ignoring elements 113, 116, 117 which are in the circuit path) starting with switch B by way of contact 25 if key B' is not operated and by way of contact 26 if key B' is operated. In any event it is to be understood that FIG. 1 shows the connections made by the movable contact of each switch with the fixed contacts thereof when the keys asociated with said switches are not operated. Thus, in tracing a circuit for a sound generator the circuit will follow the path determined by the switch connections as shown in FIG. 1 for those keys which are not operated, it being understood that the path through the switch will be altered by movement of the movable arm of each switch into engagement with the opposed contact of that switch. Thus, referring to FIG. 7, if a group 17 generator is to be selected for producing the note D only key B' is depressed. Accordingly, and now referring to FIG. 1, the movable arm instead of engaging contact 25 (as it does when key B' is not depressed) will now engage contact 26 which as seen in FIG. 1 is connected to contact 21 of switch A. Since the latter switch is not operated by its keys A' when the note D is to be produced, the movable arm of switch A engages contact 22 which, as seen in FIG. 1, is connected to the group 17 generators. The specific connections between the change-over switches and the sound generators has been omitted in FIG. 1 for reasons of clarity. It is to be understood however that the group of sound generators are connected to the switch contacts which are designated as leading to a specific one of the generators; i.e, contact 22 of switch A leads to group 17 sound generators, contact 28 of switch C leads to group 19 sound generators, contact 42 of switch G leads to group 16 sound generators . . . . etc.

Figure 4:
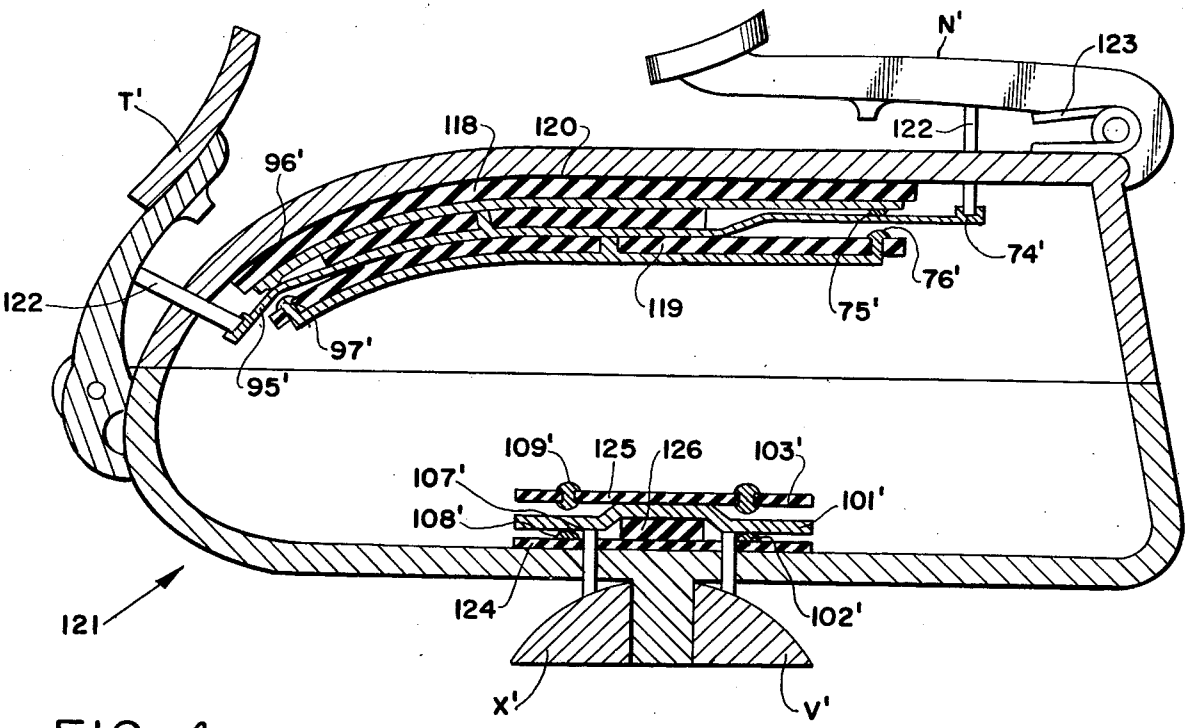
FIG. 4 is an enlarged cross sectional view of FIG. 3.
Figure 5:
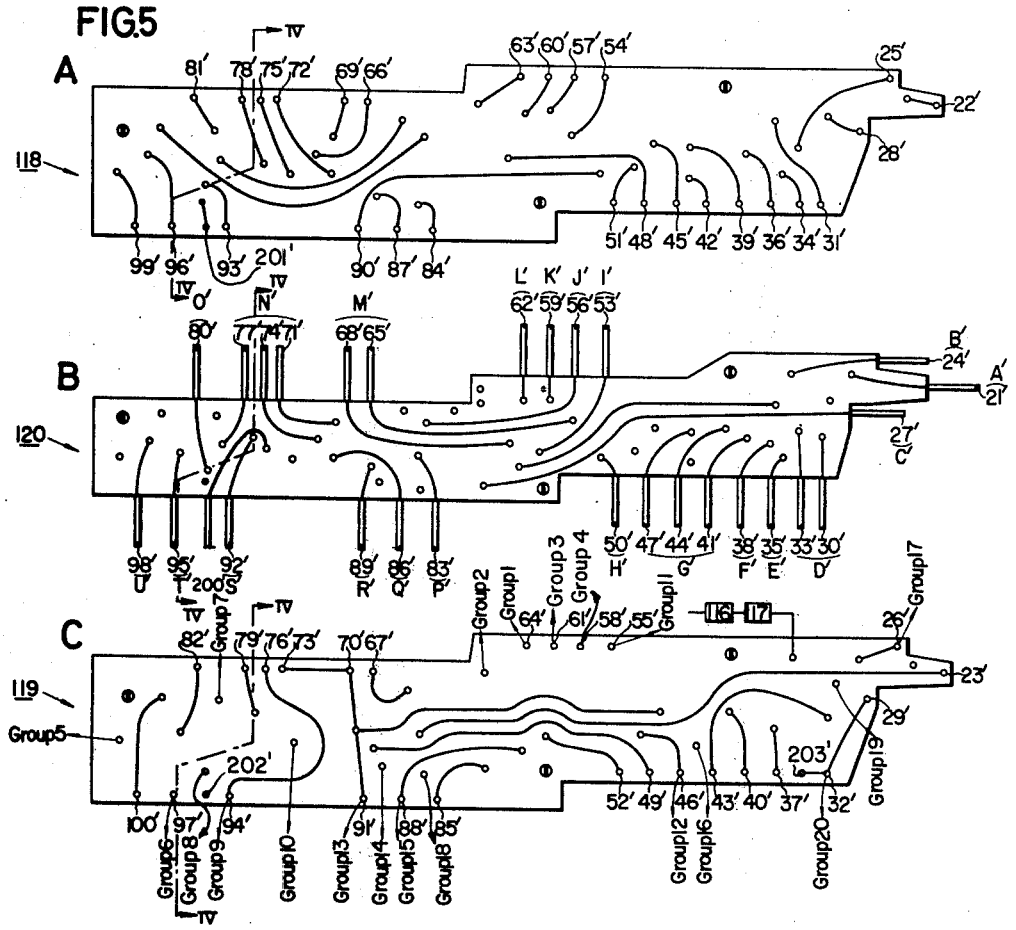
FIG. 5(A) is a front elevation of the external contact panel for the scale selection.
FIG. 5(B) is a front elevation of movable contact panel for the scale selection.
FIG. 5(C) is a wiring diagram of the internal contact panel for the scale selection provided with the wiring on the rear side thereof.

FIGS. 3 to 6, illustrate a switch casing which accommodates the keys, switches, current paths and the generators. In the casing (see FIG. 5) there is provided an external contact panel 118 which carries the contacts of switches A to U engaged by the movable contacts during non-operation of keys A' to U'. An internal panel 119 carries contacts of switches A to U which are engaged by the movable contacts upon actuation of keys A' to U'. Between the external panel 118 and internal panel 119 is interposed an intermediate contact panel having resilient movable contacts which are normally in engagement with the contacts on panel 118 but moved therefrom when keys A' to U' are depressed to urge the resilient contact members instead into engagement with the contacts on internal panel 119. FIG. 4 depicts the cross sectional structure of the switch in enlarged detail. It will be observed from this Figure that the contacts, and the connecting conductive paths, as illustrated in FIG. 5 are so arranged that a plurality of contacts and conductive paths are arranged within and between the panel layers. It will also be seen that the resilient arms are configured so as to ensure that contacts make engagement with only one of the fixed contacts in each pair of oppositely lying contacts. Thus, for example, contact 95' engages 96' but does not engage the contact 97' while contact 74' engages contact 75' but does not engage the contact 76'. The contact 107' engages contact 108' but does not engage the contact 109' and that contact 101' engages contact 102' but does not engage the contact 103'. It will thus be seen from FIG. 4 that the resilient arms of panel 120 are configured so as to ensure selective engagement and disengagement of the contacts as desired.

The manner in which the contacts on the different panels are connected by leads, or other wiring means, is illustrated in FIG. 5. Specifically, the contact panels 118, 119 and 120 are each wired at their rear sides. The contacts on panel 118 shown in FIG. 5A are adapted to be engaged on non-operation of the keys, and the contact on panel 119 are adapted to be engaged on operation of the keys. The movable contacts mounted on a movable panel 120 as shown in FIG. 5B are adapted to be interposed between panels 118 and 119. The panels when assembled in superposed alignment provide the change-over switches A to U as shown in FIG. 1. Printed circuit panels are preferred for this purpose. An input terminal for each generator in the respective group may selectively be provided either in the external contact panel 118 or in the internal contact panel 119. However, for ease of wiring, it is preferred to provide the terminals on the internal contact panel 119. The operation of the movable contact shown in FIG. 5B serving to switch-over switches A to U may be effected as disclosed, by depression of keys A' to U'. The keys A' to U' are pivotally carried by the switch casing 121 which accommodates the external contact panel 118, the internal contact panel 119 and the movable contact panel 120 interposed therebetween, the keys A' to U' being arranged as to conform to the spatial positions of, for example, the keys of a saxaphone. Instead of arranging the keys A' to U' on casing 121 as shown in FIG. 4, it is possible to arrange the keys as a keyboard or for push-button type operation. A projecting element 122 attached to individual operating keys A' to U' is engaged with an upper side of the movable contact panel 120 to move the movable contacts carried thereby, on depression of keys A' to U', from engagement with the contacts on the external contact panel 118 into engaging relation with the contacts on the internal contact panel 119 to thereby switch the current path. The movable contacts on the contact panel 120 return to normal position, wherein the contacts again engage the contacts on the external panel, upon releasing the keys, due to their resilience to re-establish the initial current path. A return spring 123 is mounted to the keys A' to U' for returning the same to their normal position upon release of finger pressure.

The scale operation keys D', G', M' and N' are intended to operatively actuate plural sets of contacts 30' and 33'; 41' and 47'; 65' and 71', 74' and 77' each set being operated simultaneously.

Figure 6:
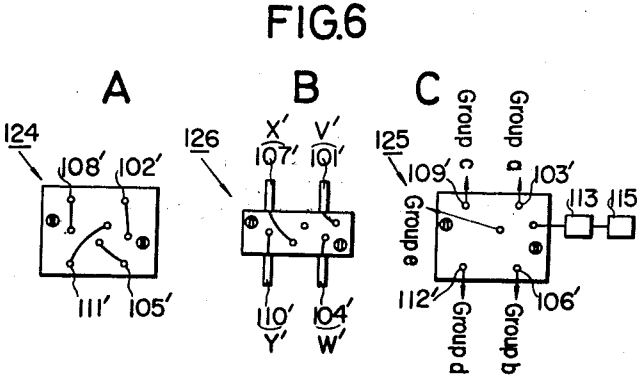
FIG. 6(A) is a front elevation of an external contact panel for selecting the octaves.
FIG. 6(B) is an elevation of the oscillation contact panel for selecting the octaves.
FIG. 6(C) is a wiring diagram of the internal contact panel for selecting the octaves and provided with the wiring on the rear side thereof.

FIG. 6 shows the external octave-selection contact panel 124, the internal octave panel 125 and the intermediate contact panel 126 carrying movable contacts which form switches V - Y, shown in FIG. 1, for selecting group *a* to *e* generators. The external contact panel 124 is provided with contacts 101', 105', 108' and 111' which are normally engaged by the movable contacts in the non-actuated position of the keys. The internal contact panel 125 is provided with contacts 103', 106', 109' and 112' which are engaged by the movable contacts on operation of the keys. Between the external and internal contact panels 124 and 125 is disposed the movable contact panel 126 which is provided with movable contact 101', 104', 107' and 110'. These contacts are urged upon the depression of the octave operation keys V', W', X' and Y' from engagement with contacts on panel 124 and into engagement with the contacts on panel 125. The casing 121 is proportioned like a saxaphone and is provided with the operation keys A' to U' related to one another to correspond to the location of saxaphone keys on a saxaphone instrument.

The foregoing embodiments have been described in form of a musical instrument which operates as a woodwind instrument and in which an independent sound generator system is incorporated into the groups of generators, notwithstanding that a separate system could as easily be employed. The sound generators may be designed with transistorized or integrated circuits.

While certain preferred embodiments of the invention have been illustrated by way of example in the drawings and particularly described, it will be understood that various modifications may be made in the apparatus and constructions and that the invention is no way limited to the embodiments shown.

What is claimed is:

1. In combination with keys on an electrical musical instrument, the keys of which are oriented on a casing of the instrument to correspond to the orientation of keys on a woodwind or like instrument, a composite switch structure for providing a plurality of independently actuable switches and comprising at least three superposed, aligned panels at least two of which are provided with a plurality of paired contacts fixed approximate at least one of the corresponding edge thereof in facing and aligned spaced apart relation, the third panel being interposed between said two panels and carrying resilient movable contact arms each of said arms being associated with a pair of fixed contacts and conductive means extending through the respective panels for connecting individual ones of said contacts to a utilization device, said movable contact having a normal position determined by the natural resilience of the arms, and being displaceable from said normal position by said keys upon operation thereof, said movable arms engaging one of the fixed contacts in its associated pair in the said normal position thereof and engaging the other of said fixed contacts in its associated pair in an other position thereof upon actuation of selected ones of said keys.

* * * * *